US008057005B2

(12) United States Patent
Watt et al.

(10) Patent No.: US 8,057,005 B2
(45) Date of Patent: Nov. 15, 2011

(54) DROP MASS CALIBRATION METHOD BASED ON DROP POSITIONAL FEEDBACK

(75) Inventors: Russell J. Watt, Portland, OR (US); Matthew Hudson Dixon, Portland, OR (US); Lisa Marie Schmidt, Sherwood, OR (US); Jeff Lee Nelson, Tigard, OR (US)

(73) Assignee: Xerox Corporation, Norwalk, CT (US)

( * ) Notice: Subject to any disclaimer, the term of this patent is extended or adjusted under 35 U.S.C. 154(b) by 419 days.

(21) Appl. No.: 11/974,664

(22) Filed: Oct. 15, 2007

(65) Prior Publication Data

US 2009/0096823 A1 Apr. 16, 2009

(51) Int. Cl.
*B41J 29/38* (2006.01)

(52) U.S. Cl. ..... 347/14; 347/10; 347/19; 347/88

(58) Field of Classification Search ..... None
See application file for complete search history.

(56) References Cited

U.S. PATENT DOCUMENTS

| | | | | |
|---|---|---|---|---|
| 5,372,852 | A * | 12/1994 | Titterington et al. | 427/288 |
| 6,116,712 | A | 9/2000 | Laharty et al. | |
| 6,390,582 | B1 | 5/2002 | Laharaty et al. | |
| 6,527,355 | B1 | 3/2003 | Yang et al. | |
| 6,629,739 | B2 | 10/2003 | Korol | |
| 2004/0263547 | A1 * | 12/2004 | Sugahara | 347/9 |
| 2005/0083364 | A1 * | 4/2005 | Billow | 347/19 |
| 2007/0176965 | A1 * | 8/2007 | Arazaki | 347/41 |

* cited by examiner

*Primary Examiner* — Matthew Luu
*Assistant Examiner* — Justin Seo
(74) *Attorney, Agent, or Firm* — Maginot, Moore & Beck LLP

(57) ABSTRACT

A method of compensating for changes in drop mass of drop emitted by at least one ink jet of an ink jet imaging device is provided. The method comprises identifying a drop placement position on an image receiving member of an ink jet imaging device for at least one ink jet of a print head. The identified drop placement position for the at least one ink jet is compared to a default drop placement position for the at least one ink jet to determine a difference in drop placement position. A drive signal for the at least one ink jet is then adjusted in accordance with the difference in drop placement position.

12 Claims, 4 Drawing Sheets

DROP MASS CALIBRATION METHOD BASED ON DROP POSITIONAL FEEDBACK

TECHNICAL FIELD

This disclosure relates generally to drop mass calibration for an imaging device having one or more printheads, and, more particularly, to drop mass calibration based on drop positional feedback.

BACKGROUND

Ink jet printers have print heads that operate a plurality of ejection jets from which liquid ink is expelled. The ink may be stored in reservoirs located within cartridges installed in the printer, or the ink may be provided in a solid form and then melted to generate liquid ink for printing. In these solid ink printers, the solid ink may be in either pellets, ink sticks, granules or any other shape. The solid ink pellets or ink sticks are typically placed in an "ink loader" that is adjacent to a feed chute or channel. A feed mechanism moves the solid ink sticks from the ink loader into the feed channel and then urges the ink sticks through the feed channel to a heater assembly where the ink is melted. In some solid ink printers, gravity pulls solid ink sticks through the feed channel to the heater assembly. Typically, a heater plate ("melt plate") in the heater assembly melts the solid ink impinging on it into a liquid that is delivered to a print head for jetting onto a recording medium.

A typical inkjet printer uses one or more printheads. Each printhead typically contains an array of individual nozzles for ejecting drops of ink across an open gap to a receiving member to form an image. The receiving member may be recording media or it may be a rotating intermediate imaging member, such as a print drum or belt. In the print head, individual piezoelectric, thermal, or acoustic actuators generate mechanical forces that expel ink through an orifice from an ink filled conduit in response to an electrical voltage signal, sometimes called a driving signal. The amplitude, or voltage level, of the signals affects the amount of ink ejected in each drop. The driving signal is generated by a print head controller in accordance with image data. An ink jet printer forms a printed image in accordance with the image data by printing a pattern of individual drops at particular locations of a pixel array defined for the receiving medium. The locations are sometimes called "drop locations," "drop positions," or "pixels." Thus, the printing operation can be viewed as the filling of a pattern of drop locations with drops of ink.

Some ink jet print heads, such as phase change ink jet print heads, utilize inks that have melting points of 80° C. and higher. With many of these inks, optimal jetting occurs at significantly higher temperatures, such as 120° C. and above. Consequently, during printing the ink jets and other print head components must be maintained at or above these elevated jetting temperatures. The temperature of the ink reservoirs supplying liquid ink to the ink jets must also be maintained at or near the required jetting temperatures.

Prolonged use of an ink jet print head at elevated temperatures can alter print head performance and accelerate thermal stress or aging of the print head components. Thermal aging, also known as drift, can result in image degradation due to performance variations. For example, the drop mass of ejected ink drops can vary as the print head components are thermally conditioned over time. Variations in drop mass from nozzle to nozzle of a print head or from print head to print head in a multiple print head system may result in result in banding or streaking of a printed image or non sharp edges to lines or shapes due to positional errors resulting from drift.

To reduce ink drop mass variations due to thermal aging of the print heads of an ink jet printer, previously known systems implemented an open loop routine in which a controller altered the voltage level of the driving signals for the print head over time at a predefined rate that was designed to compensate for the drift of a generic print head. The variability of the drift behavior between different print heads in a printer, however, may be significant. Therefore, adjusting the driving voltages of the print heads in this manner may eventually result in print heads outputting drops at different drop masses.

SUMMARY

A method enables the adjustment of driving signal voltages to compensate for changes in drop mass of drops emitted by at least one ink jet of an ink jet imaging device. The method comprises identifying a drop placement position on an ink receiving member of an ink jet imaging device for at least one ink jet of a print head. The identified drop placement position for the at least one ink jet is compared to a default drop placement position for the at least one ink jet to determine a difference in drop placement position for the at least one ink jet. A drive signal for the at least one ink jet is then adjusted in accordance with the difference in position until the identified drop placement position is substantially the same as the default drop placement position.

In another embodiment, a system for compensating for changes in drop mass of drops emitted by at least one ink jet of an ink jet imaging device is provided. The system includes an optical sensor for detecting a drop placement position on an image receiving member of an ink jet imaging device for at least one ink jet of a print head. A position comparator compares the identified drop placement position for the at least one ink jet to a default drop placement position for the at least one ink jet to determine a difference in drop placement position between the identified drop placement position and the default drop placement position of the at least one ink jet. A drive signal adjuster then adjusts an ink jet driving signal for the at least one ink jet until the identified drop placement position is substantially equal to the default drop placement position.

In yet another embodiment, an ink jet imaging device is provided. The ink jet imaging device comprises an image receiving member, and a plurality of ink jets. Each ink jet in the plurality of ink jets is configured to emit drops of ink onto the image receiving member in accordance with an ink jet driving signal. The device includes a scanner for scanning the image receiving member and detecting a drop placement position for at least one ink jet of the plurality of ink jets. An imaging device controller is configured to compare the drop placement position of the at least one ink jet to a default drop placement position for the at least one ink jet to determine a difference in drop placement position, and to adjust a voltage of the ink jet driving signal in accordance with the difference.

In another embodiment, the dispersion of the population of the positional performance could be calculated using the same methods. Adjustments in the drive signals could be made to reduce the amount of dispersion seen.

BRIEF DESCRIPTION OF THE DRAWINGS

The foregoing aspects and other features of a printer implementing a banding adjustment for multiple printheads are explained in the following description, taken in connection with the accompanying drawings, wherein.

DETAILED DESCRIPTION

Figure 1:
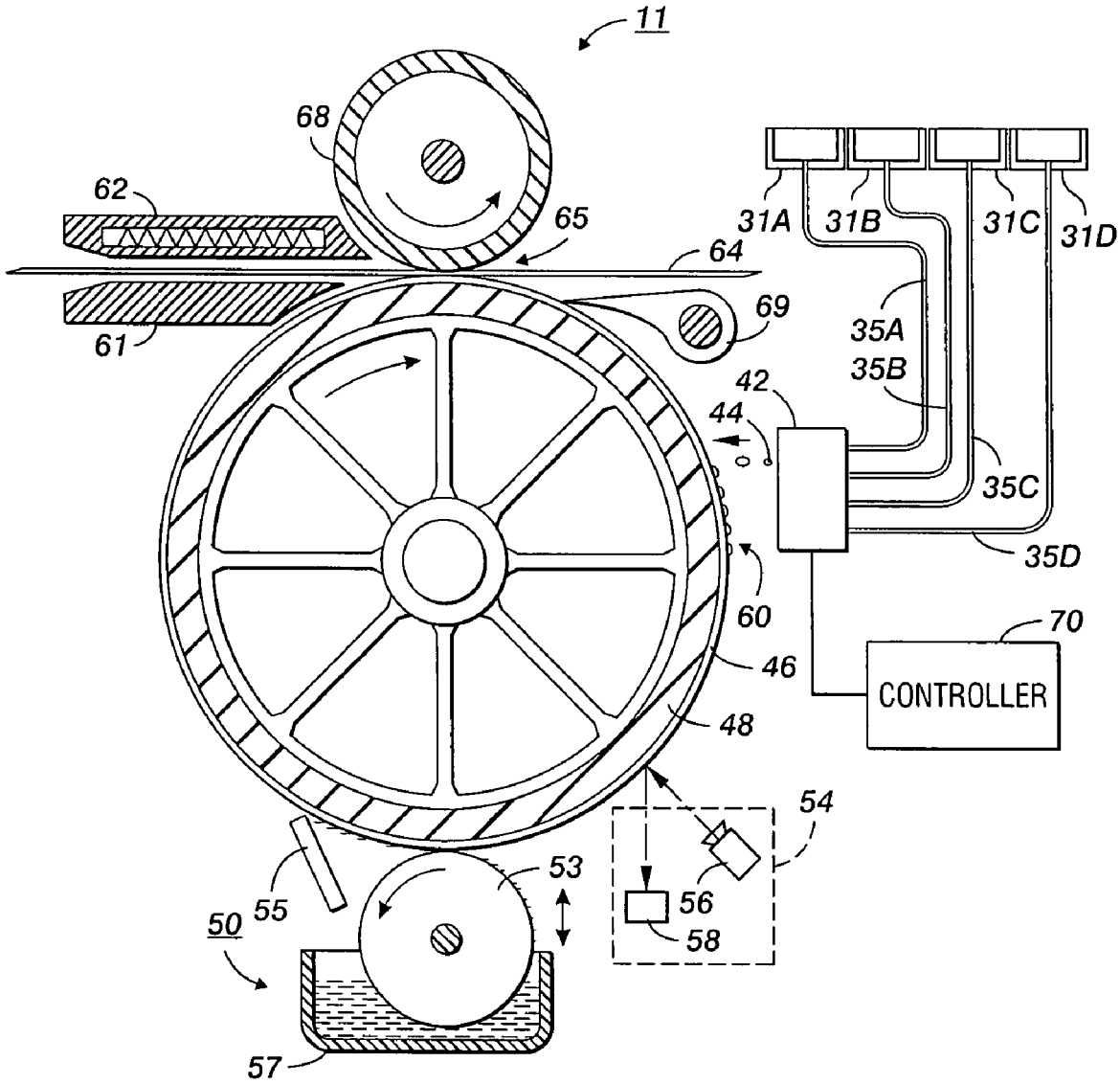
FIG. 1 is a schematic view of a solid ink imaging device.

Referring to FIG. 1, a phase change ink imaging system 11 is shown. For the purposes of this disclosure, the imaging apparatus is in the form of an inkjet printer that employs one or more inkjet printheads and an associated solid ink supply. However, the present invention is applicable to any of a variety of other imaging apparatus, including for example, laser printers, facsimile machines, copiers, or any other imaging apparatus capable of applying one or more colorants to a medium or media. The imaging apparatus may include an electrophotographic print engine, or an inkjet print engine. The colorant may be ink, toner, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

The imaging device of FIG. 1 includes a printhead assembly 42 that is appropriately supported to emit drops 44 of ink onto an imaging receiving member 48 that is shown in the form of a drum, but can equally be in the form of a supported endless belt. In other embodiments, the printhead assembly may eject drops of ink directly onto a print media substrate, without using an intermediate transfer surface. The imaging device 11 has an ink supply (not shown) which receives and stages solid ink sticks. An ink melt unit (not shown) heats the solid ink above its melting point to produce liquefied ink which is supplied to the reservoirs 31A, 31B, 31C, 31D. The ink is then supplied from the ink reservoirs 31A, 31B, 31C, 31D to the printhead 42 via the ink conduits 35A, 35B, 35C, 35D that connect the ink reservoirs with the printhead 42.

The exemplary printing mechanism 11 further includes a substrate guide 61 and a media preheater 62 that guides a print media substrate 64, such as paper, through a nip 65 formed between opposing actuated surfaces of a roller 68 and the intermediate transfer surface 46 supported by the print drum 48. Stripper fingers or a stripper edge 69 can be movably mounted to assist in removing the print medium substrate 64 from the image receiving member 46 after an image 60 comprising deposited ink drops is transferred to the print medium substrate 64.

Operation and control of the various subsystems, components and functions of the device 11 are performed with the aid of a controller 70. The controller 70 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the difference minimization function, described above. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

Figure 2:
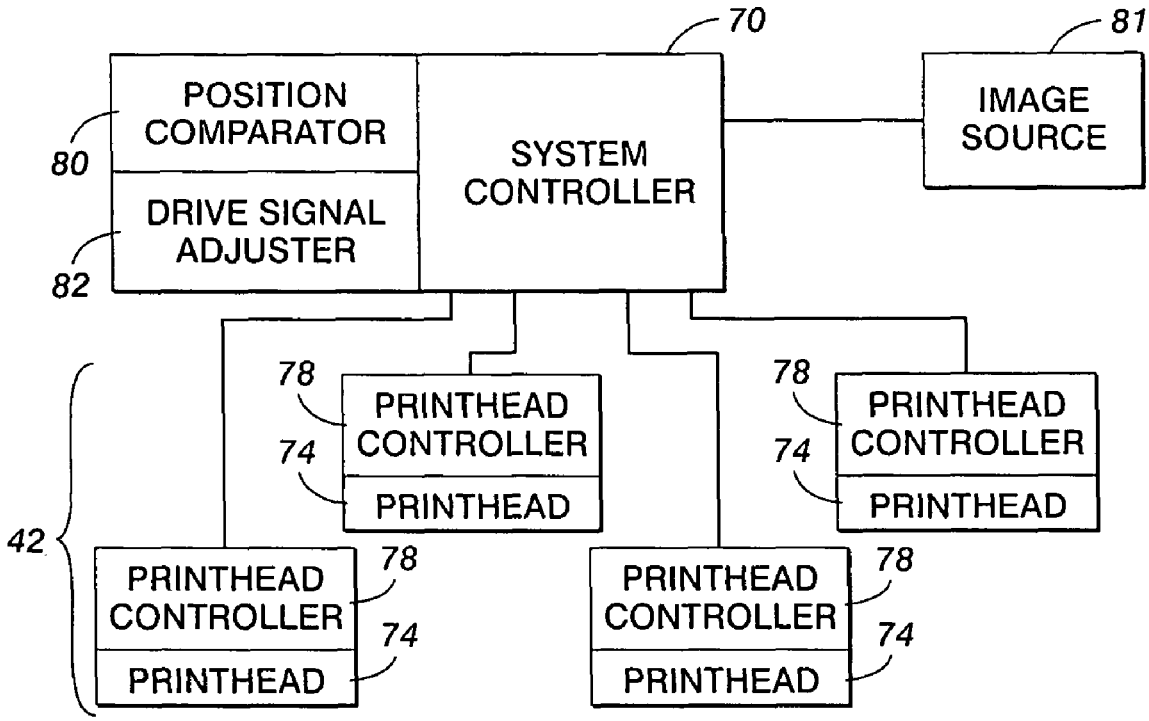
FIG. 2 is a schematic diagram of the printhead assembly and controller.

FIG. 2 is a schematic diagram of an embodiment of a printhead assembly 42 and controller. The printhead assembly 42 may include a plurality of printheads 74. FIG. 2 shows an embodiment of a printhead assembly having four printheads 74. The printheads may be arranged end-to-end in a direction transverse to the receiving surface path in order to cover different portions of the receiving surface. The end-to-end arrangement enables the printheads 74 to form an image across the full width of the image transfer surface of the imaging member or a substrate.

Figure 3:
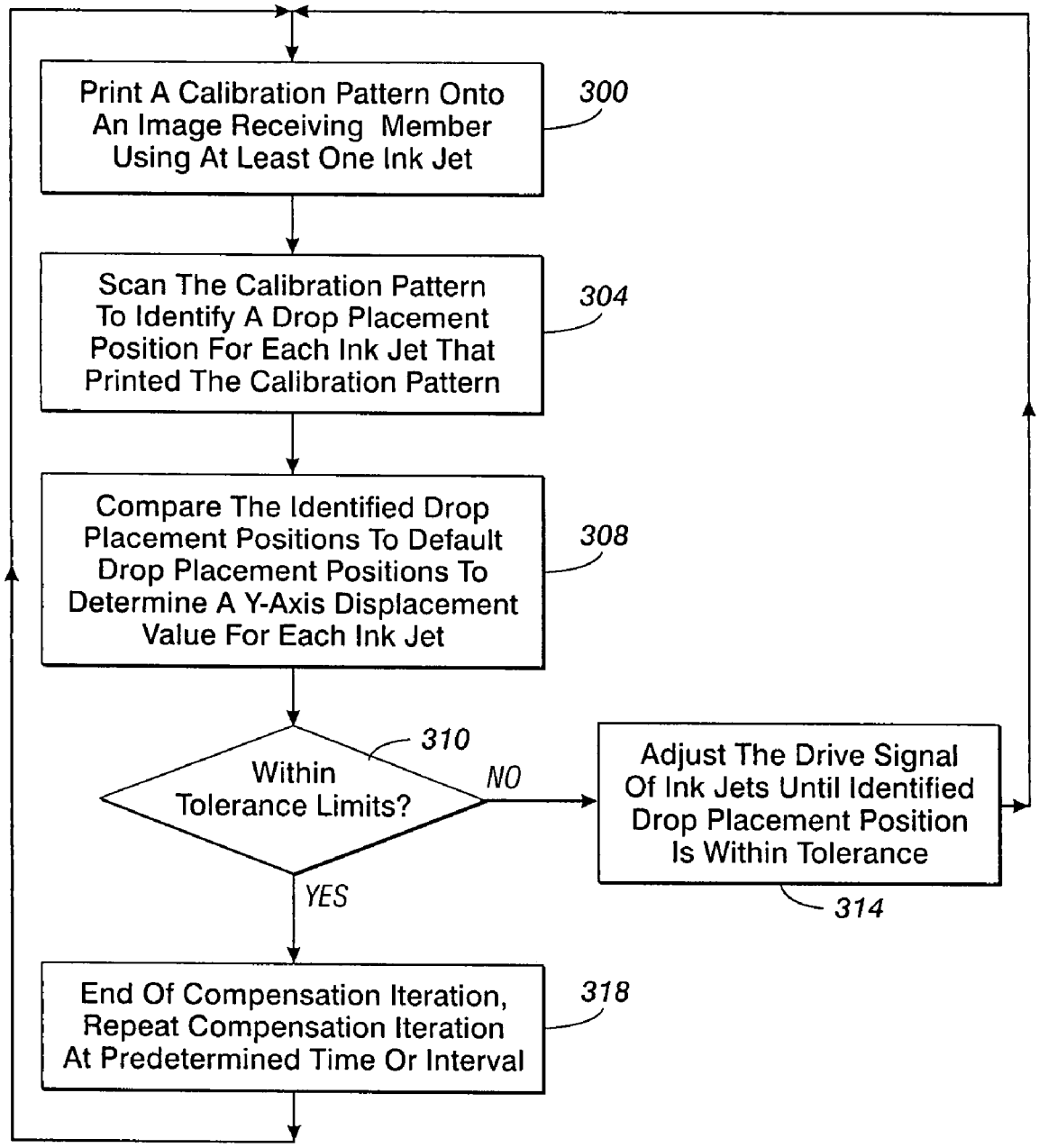
FIG. 3 is a flowchart of a drop mass compensation method.

The operation of each printhead is controlled by one or more printhead controllers 78. In the embodiment of FIG. 3, there is provided one printhead controller 78 for each printhead. The printhead controllers 78 may be implemented in hardware, firmware, or software, or any combination of these. Each printhead controller may have a power supply (not shown) and memory (not shown). Each printhead controller 78 is operable to generate a plurality of driving signals for causing selected individual ink jets (not shown) of the respective printheads to eject drops of ink 44. A driving signal may be a periodic signal that is sent to a nozzle and is well known to those skilled in the art. The voltage level, or amplitude, of the driving signal may be varied to adjust the amount of mass in the ink drop ejected by the nozzle. Each ink jet employs an ink drop ejector that responds to the drive signal. Exemplary ink drop ejectors include, but are not limited to, piezoelectric, thermal, and acoustic type ejectors.

During operations, the controller 70 receives print data from an image data source 81. The image data source 81 can be any one of a number of different sources, such as a scanner, a digital copier, a facsimile device, or a device suitable for storing and/or transmitting electronic image data, such as a client or server of a network, or onboard memory. The print data may include various components, such as control data and image data. The control data includes instructions that direct the controller to perform various tasks that are required to print an image, such as paper feed, carriage return, print head positioning, or the like. The image data are the data that instructs the print head to mark the pixels of an image, for example, to eject one drop from an ink jet print head onto an image recording medium. The print data can be compressed and/or encrypted in various formats.

The controller 70 generates the printhead image data for each printhead 74 of the printhead assembly 42 from the control and print data received from the image source 81, and outputs the image printhead data to the appropriate printhead controller 78. The printhead image data may include the image data particular to the respective printhead. In addition, the printhead image data may include printhead control information. The printhead control information may include information such as, for example, instructions to adjust the drop mass generated by a particular printhead or ink jet. The printhead controllers 78 upon receiving the respective control and print data from the controller, generate driving signals for driving the ink jets to expel ink in accordance with the print and control data received from the controller. Thus, a plurality of drops may be ejected at specified positions and at specified fill levels on the image receiving member in order to produce an image in accordance with the print data received from the image source.

The imaging device may include a drum sensor 54. The drum sensor is configured to detect, for example, the presence, intensity, and/or location of ink drops jetted onto the receiving member by the inkjets of the print head assembly. In one embodiment, the drum sensor includes a light source 56 and a light sensor 58. The light source 56 may be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment may include three linear arrays, one for each of the colors red, green, and blue. Alternatively, all of the LEDS may be arranged in a single linear array in a repeating sequence of the three colors. The LEDs of the light source are coupled to the sensor controller 208, which selectively activates the LEDs. The controller 70 generates signals indicating which LED or LEDs to activate in the light source.

The reflected light is measured by the light sensor 58. The light sensor 58, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array may be configured to translate across the image substrate. For example, the linear array may be mounted to a movable carriage that translates across image receiving member. Other devices for moving the light sensor may also be used.

Thus, a reflectance may be detected that corresponds to each ink jet and/or to each pixel location on the receiving member. The light sensor 58 is configured to output reflectance signals the detected reflectance to the print controller 70. The reflectance signals may be used by the print controller to determine information pertaining to the ink drops ejected onto the receiving member such as the presence and/or location of ink drops. For example, the controller may include a position comparator 82 (FIG. 2) for comparing detected drop placement locations or positions to default drop placement positions to determine any differences drop placement position for the ink jets. Based on this information, the print controller may make adjustments such as increasing or decreasing drop size and/or velocity. In order to adjust or modulate the drop volume of drops ejected by the ink jets, the print controller may include a drive signal adjuster 84 (FIG. 2) that is configured to adjust the voltage level, or amplitude, of one or more segments, or pulses, of the driving signal. In one embodiment, in order to increase or decrease the drop mass of a drop emitted by an ink jet, the amplitude, or voltage level, of all or a portion of the drive signal may be increased or decreased accordingly.

As part of a setup routine, the print heads of the imaging device may be subjected to a normalization process as is known in the art to ensure emitted drops have substantially the same drop from nozzle to nozzle as well as from print head to print head. As discussed above, however, thermal aging, or drift, may cause variability in drop mass, often resulting in a loss of drop mass over time. Previously known systems implemented an open loop drift controller that increased the voltage level of the driving signals over time to compensate for the loss in drop mass due to thermal aging. Drift behavior, however, may vary from print head to print head due to various factors such as variability in the physical characteristics or the electrical characteristics of print heads that may be introduced during print head manufacture and assembly. Therefore, increasing the voltage level of the driving signals as a function of time may not be effective in maintaining a substantially uniform drop mass from print head to print head.

As an alternative to the open loop method of compensating for drop mass variations due to drift, a drop mass compensation method is proposed in which drop mass adjustments are made in accordance with changes in drop placement with respect to the receiving member. The placement of a drop on a receiving medium, such as drum, depends on the rotating velocity of the drum and the velocity after ejection of a drop. The drum velocity may be accurately controlled. Therefore, the actual drop placement depends predominantly on drop velocity. A drop having a higher drop velocity may have a shorter flight time between the ink jet nozzle and the receiving medium than a drop having a lower drop velocity. Consequently, the receiving member has more time to move in the process direction (Y axis) before the ink drop having the lower drop velocity reaches the member. Thus, the ink drop having the lower drop velocity may land on the receiving member at a position that is further upstream in the process direction than the drop having the higher drop velocity. As is known in the art, the drop velocity of a drop ejected by an ink jet is closely correlated to the drop mass of the drop. Consequently, changes in drop mass of drops output by an ink jet may be detected by monitoring changes in the drop placement position along the Y-axis of the image receiving member.

A method for compensating for changes in drop mass based on drop placement data is shown in FIG. 3. The method begins with the ejection of a calibration pattern onto an image receiving member (block 300). To print a calibration pattern, the controller 70 provides appropriate control signals to the print head assembly 42 to cause one or more ink jets to each eject a drop of ink having a default drop mass at a predetermined time onto the image receiving member. Calibration patterns for evaluating drop placement positions are well known.

After the calibration pattern has been printed onto the image receiving member, a drop placement position corresponding to one or more of the ink jets used to print the calibration pattern is identified (block 304). A drop placement position corresponding to an ink jet may be identified by optically scanning the calibration pattern with the drum sensor to the location of ink drops jetted onto the receiving member by the inkjets of the print head assembly. The drum sensor is configured to output reflectance signals indicative of the optical characteristic, and hence, the drop placement positions for the ink jets, to the controller. As an alternative to the use of the drum sensor to perform scans to detect drop placement positions, a paper based scanner may be used. For example, calibration patterns may be printed onto a recording medium such as a sheet of paper and the printed sheet may then be scanned by the a scanner or similar image acquisition device in order to determine the current drop placement positions.

Once the drop placement position for at least one ink jet has been identified, the printer controller 70 compares the drop placement position of an ink jet to an ideal, or default drop placement position for the ink jet to determine the difference between the drop placement position and the default drop placement position for the ink jet. As described above, changes in drop placement position in the process direction, or along the Y axis of the receiving member, over time may indicate a corresponding change in the drop mass of the drops emitted by an ink jet. Thus, in one embodiment, the print controller 14 is configured to calculate a process direction displacement, or Y axis displacement, value corresponding to the ink jet (block 310). The Y axis displacement value corresponds to the magnitude of the difference in drop placement position along the Y axis of the receiving member between the identified drop placement position and the default drop placement position. The default drop placement position may be determined experimentally or empirically. For example, in one embodiment, default drop placement positions corresponding to the ink jets of a print head assembly are determined as the printer leaves the final assembly line and has been calibrated although the default drop placement positions may be determined at any suitable time. The default drop placement positions may be determined as part of a setup routine in which one or more initial calibration patterns are printed onto the receiving drum and scanned by the optical detector to determine the default drop placement positions for each ink jet. Once the default drop placement positions have been determined, the default drop placement position for each ink jet may be stored in memory for subsequent access by the controller. Alternatively, the default drop placement positions may be programmed into the controller.

After the Y axis displacement value has been determined for at least one ink jet, the printer controller 14 determines whether the difference between the identified drop placement position and the default drop placement position is within an acceptable range or tolerance. In one embodiment, the Y axis displacement value is compared to a predetermined Y axis displacement threshold value or range of values to determine if the Y axis displacement is within tolerance (block 310). If the Y axis displacement value for an ink jet is within tolerance, then a determination may be made that there has been no significant change in the drop mass of the drops output by the ink jet and a drop mass adjustment for the ink jet does not have to be performed (block 314). If the Y axis displacement value for an ink jet is not within tolerance, then a determination may be made that the drop mass of drops output by an ink jet has changed to a significant enough degree that a drop mass adjustment may be required.

If the Y axis displacement value for an ink jet has been determined to not be within tolerance, the voltage level or amplitude of all or a portion of the driving signal for the ink jet may be adjusted until the identified drop placement position for an ink jet corresponds substantially to the default drop placement position for the ink jet (block 318). As described above, the drive signal for an ink jet may be adjusted in order to increase or decrease the drop mass output by the ink jet. By modifying the drive signal to adjust the drop placement position, a corresponding adjustment of the drop mass of drops output by the ink jet takes place. By adjusting the drop placement position of an ink jet so that it is substantially equal to the default drop placement position, the drop mass of drops output by the ink jet may then be substantially equal to the calibrated, or default drop mass.

The modification of the drive signals may include incrementally adjusting the drive signals until the current drop placement position is substantially the same as the default drop placement position indicating that the current drop mass of drops output of an ink jet is within tolerance. For example, in one embodiment, the Y axis displacement value may be used to generate a drive signal scaling factor which may then be used to adjust the drive signal. The controller may be programmed with scaling factors and their corresponding Y axis displacement values. The scaling factors and corresponding Y axis displacement values may be stored in memory as a data structure such as a table. Alternatively, the print controller may include a program or subroutine for calculating the scaling factor and Y axis displacement relationship. Depending on the actual components and construction of the printhead assembly, there may be a linear relationship between the voltage level of the driving signal and the Y axis displacement. The relationship, however, need not be linear. Once the driving signal of one or more ink jets have been adjusted, the adjusted voltage levels of the driving signals may be saved in memory for the print controller to access so that the adjusted voltages may be used to subsequently drive the ink jet nozzles at a desired level.

Compensating for drop mass changes based on drop position feedback may require iterations. For example, after a first round of adjustments have been made to the driving signals of the ink jets in accordance with the detected Y axis displacement values, the process may be repeated. A new set of calibration patterns may be printed onto the receiving member and scanned by the drum sensor, and the Y axis displacement value may be detected and further adjustments to the drive signals may then be made if necessary.

Calibration scans may be periodically performed by setting a calibration interval. Calibration intervals may be stored in memory for access by the print controller. A calibration interval may be selected in any suitable manner. For example, a calibration interval may indicate that a calibration scan is to be performed after a predetermined amount of time has elapsed or after a predetermined number of images have been printed. The intervals for performing the calibration scans may be adjusted depending on a number of factors such as, for example, print job characteristics and/or environmental conditions. For example, the interval may be adjusted based on the type of media, the type of ink, image type, environment, etc.

Figure 4:
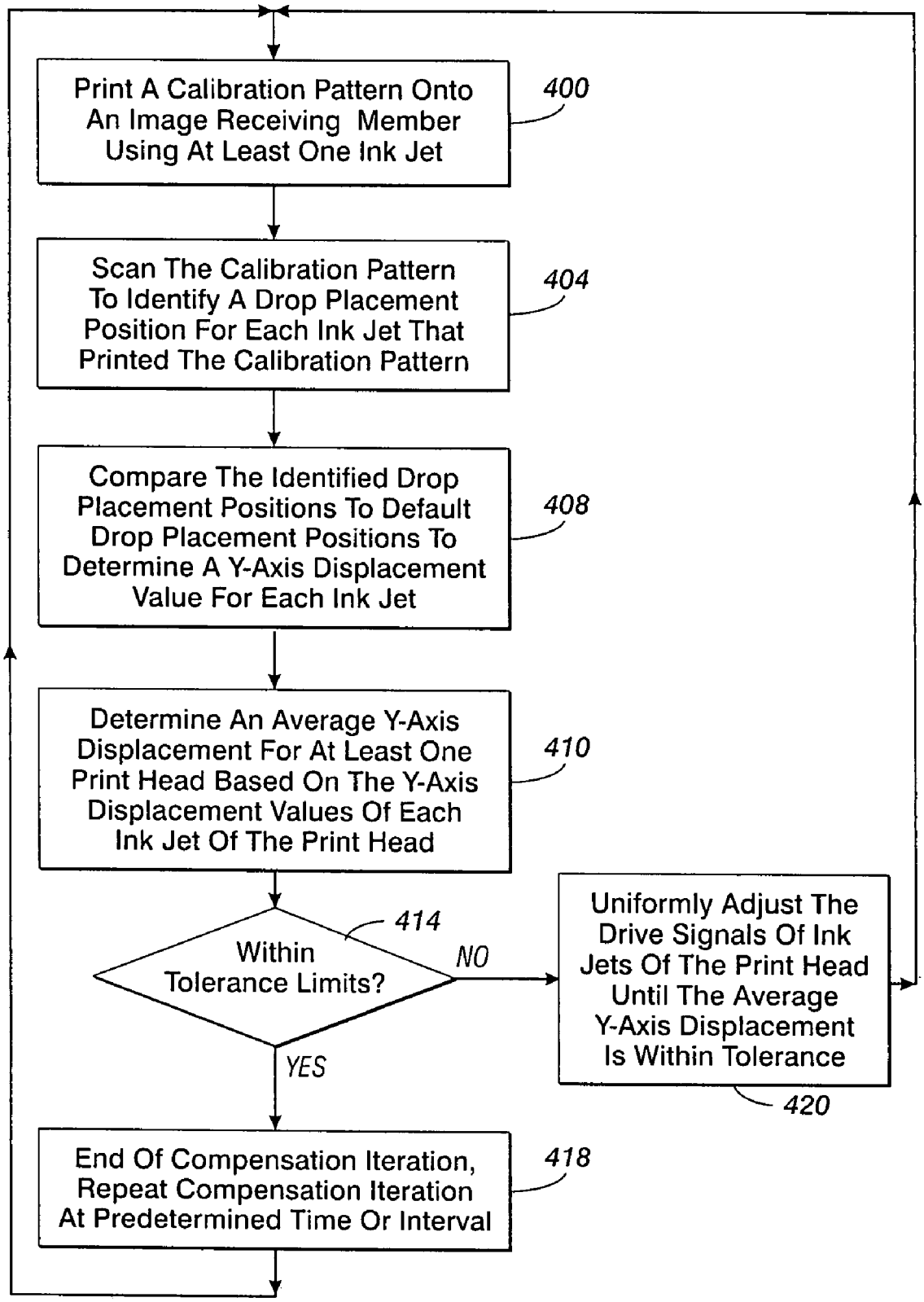
FIG. 4 is a flowchart of another embodiment of a drop mass compensation method.

The method described above is effective for compensating for drop mass changes on a per ink jet basis. A similar method may be used to compensate for drop mass changes on a row to row basis or even on a print head to print head basis. For example, FIG. 4 shows an embodiment of a method of compensating for drop mass changes due to drift on a head to head basis. Similar to the method of FIG. 3, the head to head compensation method begins with the ejection of drops from a plurality of print heads to print a calibration pattern onto an image receiving member (block 400). After the calibration pattern has been printed onto the image receiving member, drop placement positions corresponding to the ink jets used to print the calibration pattern are identified (block 404). The drop placement position for each ink jet is then compared to a default placement position for each ink jet to determine a Y axis displacement value for each ink jet (block 408).

Once a Y axis displacement value is determined for each ink jet, an average Y axis displacement value is determined for each printhead (block 410). The average Y axis displacement value for a print head corresponds to the average of the Y axis displacement values of the ink jets of the print head. Determining the average Y axis displacement value is within the knowledge of those skilled in the art and may be determined in any suitable manner.

Similar to the jet to jet compensation method, the print controller 14 may then determine whether the average Y axis displacement value of drops from all jets or a logical subset of drop(s) coming from a corresponding logical subset of jet(s) is with tolerance (block 414). If the average Y axis displacement value for a print head is within tolerance, then a determination may be made that there has been no significant change in the drop mass of the drops output by the ink jet and a drop mass adjustment for the ink jet does not have to be performed (block 418). If the Y axis displacement value for an ink jet is not within tolerance, then a determination may be made that the drop mass of drops output by the ink jets of a print head has changed to a significant enough degree that a drop mass adjustment may be required. If the average Y axis displacement value for a print head has been determined to not be within tolerance, the voltage level or amplitude of all or a portion of the driving signals for each ink jet may be uniformly adjusted until the average Y axis displacement is within tolerance (block 420).

Those skilled in the art will recognize that numerous modifications can be made to the specific implementations described above. For example, those skilled in the art will recognize that while exemplary techniques for detecting drop placement positions have been discussed that other techniques may be used as well. Also, while the embodiments above have been described with reference to a solid ink offset printer, the drop mass compensation method set out above may be used with any ink jet imaging device, including those that directly print to image receiving members. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of adjusting an ink jet imaging device, the method comprising:

identifying a drop placement position on a rotating image receiving member of an ink jet imaging device for an ink drop ejected by at least one ink jet of a print head, the rotating image receiving member rotating in a process direction;

comparing the identified drop placement position for the ink drop ejected by the at least one ink jet on the rotating image receiving member to a default drop placement position on the rotating image receiving member for the at least one ink jet to determine a difference in drop placement position between the identified drop placement position on the rotating image receiving member and the default drop placement position of the at least one ink jet;

calculating a difference in position along the process direction of the rotating image receiving member between the identified drop placement position of the ink drop ejected by the at least one ink jet on the rotating image receiving member and the default drop placement position of the at least one ink jet, the difference in position along the process direction of the rotating image receiving member corresponding to a process direction displacement for ink drops ejected by the at least one ink jet onto the rotating image receiving member;

comparing the process direction displacement for ink drops ejected by the at least one ink jet onto the rotating image receiving member to a threshold value to determine whether a mass of the ink drop ejected by the at least one ink jet onto the rotating image receiving member is within tolerance limits for an ink drop mass corresponding to the default drop placement position for the at least one ink jet; and adjusting an amplitude of a voltage of an ink jet driving signal for the at least one ink jet in response to the process direction displacement mass of the ink drop ejected onto the rotating image receiving member by the at least one ink jet not being within the tolerance limits.

2. The method of claim 1, further comprising:

printing a calibration pattern onto the rotating image receiving member using the at least one ink jet of a print head prior to the identification of the drop placement positions on the rotating image receiving member.

3. The method of claim 2, the identification of the drop placement positions further comprising:

optically scanning the calibration pattern on the rotating image receiving member with a drum sensor mounted in the ink jet imaging device proximate to the rotating image receiving member, the drum sensor having a light source and a light sensor to generate electrical signals corresponding to an amount of light reflected by the calibration pattern on the rotating image receiving member to enable identification of ink drops in the calibration pattern on the rotating image receiving member.

4. The method of claim 3, the optical scanning of the image receiving member further comprising:

illuminating the calibration pattern on the rotating image receiving member with the light source of the drum sensor;

generating electrical signals with the light sensor that correspond to the amount of light received by the light sensor from the light reflected from the calibration pattern on the rotating image receiving member, the electrical signals corresponding to the amount of reflected light received by the light sensor being indicative of positions where ink drops are located on the rotating image receiving member; and processing the electrical signals generated by the light sensor with a controller having a position comparator to determine spatial differences between ink drop positions corresponding to the electrical signals generated by the light sensor and default drop placement positions.

5. The method of claim 1, the adjustment of the ink jet driving signal voltage amplitude further comprising:

adjusting the amplitude of the voltage of the ink jet driving signal for the at least one ink jet with reference to a predetermined scaling factor that corresponds to the process direction displacement for ink drops ejected by the at least one ink jet onto the rotating image receiving member.

6. The method of claim 1 further comprising:

storing in a memory the adjusted amplitude of the voltage of the ink jet driving signal for the at least one ink jet to enable the at least one ink jet to be operated with the adjusted amplitude of the voltage of the ink jet driving signal and eject ink drops onto the rotating image receiving member having a mass within the tolerance limits.

7. The method of claim 1, the ink jet imaging device being configured to eject phase change ink onto the rotating image receiving member.

8. The method of claim 1, the rotating image receiving member being a rotating drum.

9. A system for compensating for changes in drop mass in ink jet printing, the system comprising:

a print head having ink jets configured to eject drops of phase change ink;

a rotating image receiving member positioned opposite the print head to receive ink drops ejected by the ink jets of the print head as the rotating image receiving member rotates past the print head in a process direction;

a drum sensor having a light source and a light sensor, the drum source being positioned proximate the rotating image receiving member to enable the light source to direct light towards the rotating image receiving member and to enable the light sensor to receive light reflected by the rotating image receiving member, the light sensor being configured to generate electrical signals corresponding to an amount of reflected light received by the light sensor;

a controller having a position comparator that is operatively connected to the light sensor to receive the electrical signals generated by the light sensor, the position comparator being configured to determine spatial differences between ink drop positions corresponding to the electrical signals generated by the light sensor and default drop placement positions for the ink jets that ejected the ink drops at the ink drop positions corresponding to the electrical signals and the controller being configured to determine a difference in drop placement position in the process direction of the rotating image receiving member between the ink drop positions corresponding to the electrical signals generated by the light sensor and the default drop placement positions for the ink jets that ejected the ink drops at the ink drop positions corresponding to the electrical signals; and a print controller operatively connected to the printhead and configured to operate the ink jets in the print head to eject ink drops from the ink jets of the print head onto the rotating image receiving member and to compare the difference in the process direction of the rotating image receiving member for each ink jet that ejected an ink drop onto the rotating image receiving member to a threshold to determine whether each ink drop ejected onto the rotating image receiving member has a mass that is within tolerance limits, and to adjust an amplitude of a voltage of an ink jet drive signal for each ink jet that ejected an ink drop having a mass not being within the tolerance limits.

10. The system of claim 9 wherein the print controller operates the ink jets of the print head to print a calibration pattern onto the rotating image receiving member.

11. The system of claim 9, the controller being configured to adjust the amplitude of the voltage of the ink jet drive signal for each ink jet that ejected an ink drop on the rotating image receiving member that had a mass outside the tolerance limits with reference to a scaling factor that corresponds to the difference in the process direction of the rotating image receiving member for each ink jet that ejected an ink drop on the rotating image receiving member that had a mass outside the tolerance limits.

12. The system of claim 9, the rotating image receiving member being a rotating drum.

* * * * *